US012638272B1

(12) United States Patent
Frost

(10) Patent No.: US 12,638,272 B1
(45) Date of Patent: May 26, 2026

(54) UNIVERSAL MOUNTING SYSTEM

(71) Applicant: Michael Marcjohn Frost, Fallbrook, CA (US)

(72) Inventor: Michael Marcjohn Frost, Fallbrook, CA (US)

( * ) Notice: Subject to any disclaimer, the term of this patent is extended or adjusted under 35 U.S.C. 154(b) by 0 days.

(21) Appl. No.: 19/093,379

(22) Filed: Mar. 28, 2025

(51) Int. Cl.
*F41G 11/00* (2006.01)
*F41G 1/16* (2006.01)
*F41G 1/30* (2006.01)
*F41G 1/387* (2006.01)

(52) U.S. Cl.
CPC ..... *F41G 11/003* (2013.01); *F41G 1/16* (2013.01); *F41G 1/30* (2013.01); *F41G 1/387* (2013.01); *F41G 11/004* (2013.01)

(58) Field of Classification Search
CPC . F41G 1/16; F41G 1/30; F41G 11/003; F41G 11/004; F41G 1/387
See application file for complete search history.

(56) References Cited

U.S. PATENT DOCUMENTS 2,193,094 A * 3/1940 Gilbert ..... F41G 11/004 24/19
2,526,126 A * 10/1950 Gagnier ..... F41G 11/003 42/127
6,931,779 B1 * 8/2005 Galuppo, Jr. ..... F41G 11/001 42/114
D536,055 S 1/2007 Frost
7,305,789 B2 * 12/2007 Frost ..... F41G 11/003 42/126
9,459,078 B1 * 10/2016 Kincel ..... F41G 11/004
9,677,854 B1 * 6/2017 Tran ..... F41G 11/003
9,964,380 B1 * 5/2018 Oglesby ..... F41C 23/16
10,240,901 B1 * 3/2019 Cheng ..... F41A 35/00
10,302,396 B1 * 5/2019 Ray ..... F41G 1/473
10,551,145 B2 * 2/2020 Kincel ..... F41C 23/16
11,313,646 B1 * 4/2022 Simon ..... F41G 1/16
11,976,899 B1 * 5/2024 Skelton ..... F41C 27/00
(Continued)

FOREIGN PATENT DOCUMENTS

DE 202018000599 U1 * 4/2018 ..... F41C 27/00
KR 200446365 Y1 * 10/2009 ..... F41C 27/00

OTHER PUBLICATIONS

Machine Translation of Kim. KR 200446365 Y1. Oct. 22, 2009. (Year: 2009).*

*Primary Examiner* — Gabriel J. Klein
(74) *Attorney, Agent, or Firm* — Larson & Larson; Frank Liebenow

(57) ABSTRACT

A system and method of mounting a selected red dot emitter/reflex sight to a weapon includes affixing the selected red dot emitter/reflex sight to a mounting plate selected from several mounting plates. There is one mounting plate for each red dot emitter/reflex sight and each mounting plate has features for affixing one of the red dot emitters/reflex sights to the mounting plate. Next, the mounting plate is installed to a base that has a plurality of legs for engaging with the weapon. The base also has a plurality of clips and each clip slideably interfaces into a cutout of each leg. Each clip is adjustably held within the cutout by an adjustment screw. Next, each clip is engaged with the weapon and each adjustment screw is tightened to hold the base to the weapon, therefore, holding the one red dot emitter/reflex sight to the weapon.

16 Claims, 5 Drawing Sheets

(56) References Cited

U.S. PATENT DOCUMENTS 12,066,272 B2 * 8/2024 Mayberry ..... F41G 11/001
2003/0074824 A1 * 4/2003 Arachequesne ..... F41G 1/17 42/111
2007/0169393 A1 * 7/2007 Frost ..... F41G 11/003 42/74
2008/0216379 A1 * 9/2008 Javorsky ..... F41G 1/345 42/115
2011/0030263 A1 * 2/2011 Larsson ..... F41C 27/00 42/90
2013/0111799 A1 * 5/2013 Lee ..... F41G 11/001 42/106
2013/0219767 A1 * 8/2013 Peterson ..... F41G 11/003 29/428
2015/0285583 A1 * 10/2015 Mayberry ..... F41A 23/08 42/71.01
2015/0285584 A1 * 10/2015 Mayberry ..... F41G 11/005 42/71.01
2017/0059277 A1 * 3/2017 Justice ..... F41G 11/003
2017/0184375 A1 * 6/2017 Huff ..... F41G 11/003
2018/0202770 A1 * 7/2018 Pniel ..... F41G 1/16
2018/0216911 A1 * 8/2018 Jen ..... F41G 11/003
2019/0249949 A1 * 8/2019 Cahill ..... F41C 27/00
2020/0011636 A1 * 1/2020 Jen ..... F41C 33/007
2020/0208946 A1 * 7/2020 Cahill ..... F41G 11/001
2020/0272044 A1 * 8/2020 Walker ..... F41G 11/003
2021/0025673 A1 * 1/2021 Niswander ..... F41G 1/30
2021/0156650 A1 * 5/2021 Harriman ..... F41G 1/10
2021/0270572 A1 * 9/2021 Dawson, Jr. ..... F41G 11/001
2022/0268553 A1 * 8/2022 Roth ..... F41G 11/001
2023/0184517 A1 * 6/2023 Davis ..... F41G 11/003 42/90
2023/0341213 A1 * 10/2023 Lee ..... F41G 11/003
2024/0110769 A1 * 4/2024 Underwood ..... F41G 11/001
2025/0012548 A1 * 1/2025 Langdon ..... F41G 11/001
2025/0207893 A1 * 6/2025 Lee ..... F41G 11/003
2025/0369723 A1 * 12/2025 Larsson ..... F41G 1/16

* cited by examiner

UNIVERSAL MOUNTING SYSTEM

FIELD OF THE INVENTION

This invention relates to the field of firearms and more particularly to a mounting system for various red dot emitters or reflex sights.

BACKGROUND OF THE INVENTION

Anyone who has watched much television, especially crime dramas or military themed shows, has seen the use of a red dot emitter. In such, a red dot emitter is mounted onto a weapon (e.g., a firearm) and adjusted to emit red light that is very directional (e.g. emitted using a laser diode) to coincide with the path of a bullet when the weapon is fired. One might have also seen a reflex sight in which an image (e.g., a reticle or cross hairs) is projected on a partially reflecting glass element of a sight, therefore allowing the user of a weapon to see the image superimposed on the target.

There are many different red dot emitters and reflex sights, each having a different mounting system, and each requiring a specialized mounting bracket. Therefore, a dealer of such red dot emitters must carry a different mounting bracket for each red dot emitter and/or reflex sight that they market. This creates inventory, stocking real estate, and cost issues as each individual mounting bracket takes up space, must be accounted for, and has a cost. Consider a maker of mounting devices for red dot emitters and reflex sights making a different mounting device for each different mounting configuration. This requires the manufacturing, shipping, stocking and marketing of many different mounting systems, one for each red dot emitter and for each reflex sight. This is further compounded for different styles of weapons. Consider a situation in which there are 20 different red dot emitters and reflex sights and three different styles of weapons yielding 60 (20 time 3) unique configurations 60 different mounting devices.

What is needed is a universal red dot emitter and reflex sight mounting system that reduces inventory, stocking real estate, and costs.

SUMMARY OF THE INVENTION

In one embodiment, a system for mounting a red dot emitter/reflex sight to a weapon is disclosed including a base that has an orifice for accepting a mounting plate. The base has legs for engaging with the weapon and each leg has a clip that slideably interfaces into a cutout of each leg. Each clip is adjustably held within the cutout by an adjustment screw. The mounting plate is sized to fit and be held in the orifice and the mounting plate has features for affixing a red dot emitter/reflex sight to the mounting plate. Note it is anticipated to have a different mounting plate for each red dot emitter/reflex sight that is supported.

In another embodiment, a method for mounting a red dot emitter/reflex sight to a weapon is disclosed including affixing a mounting plate within an orifice of a base that has legs for engaging with the weapon. The mounting plate has features for affixing the red dot emitter/reflex sight to the mounting plate. Next, affixing the red dot emitter/reflex sight to the mounting plate (e.g., using screws, sliding mechanisms, etc.). Next, engaging clips with the weapon, each clip being slideably interfaced into a cutout of each leg of the plurality of legs and each clip being adjustably held within the cutout by an adjustment screw then tightening the adjustment screw of each of the plurality of clips to hold the base, and therefore, the red dot emitter/reflex sight, to the weapon.

In another embodiment, a method of mounting a selected red dot emitter/reflex sight (there are several red dot emitters/reflex sights) to a weapon is disclosed including affixing the selected red dot emitter/reflex sight to a mounting plate selected from mounting plates formed to hold each of the red dot emitters/reflex sights (e.g., there is one mounting plate for each red dot emitter). Each mounting plate has features for affixing one of the red dot emitters/reflex sights to the mounting plate. Next, the mounting plate is installed to a base that has a plurality of legs for engaging with the weapon. The base also has clips and each clip slideably interfaces into a cutout of each leg. Each clip is adjustably held within the cutout by an adjustment screw. Next, each clip is engaged with the weapon and each adjustment screw is tightened to hold the base to the weapon, therefore, holding the red dot emitter/reflex sight to the weapon.

BRIEF DESCRIPTION OF DRAWINGS

The invention can be best understood by those having ordinary skill in the art by reference to the following detailed description when considered in conjunction with the accompanying drawings in which.

DETAILED DESCRIPTION OF THE INVENTION

Figure 1:
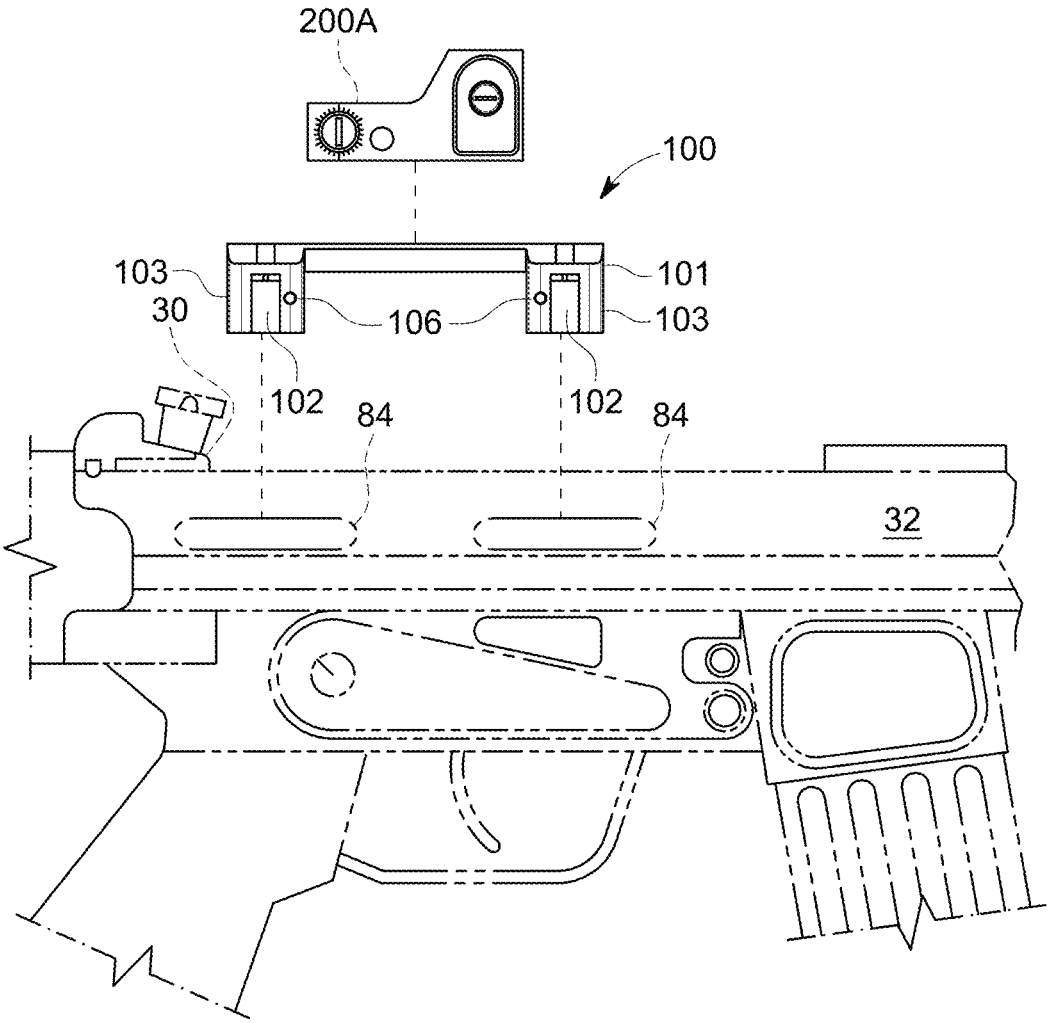
FIG. 1 is exploded view of an exemplary implementation of the red dot emitter/reflex sight mounting system attached to a weapon.
Figure 2:
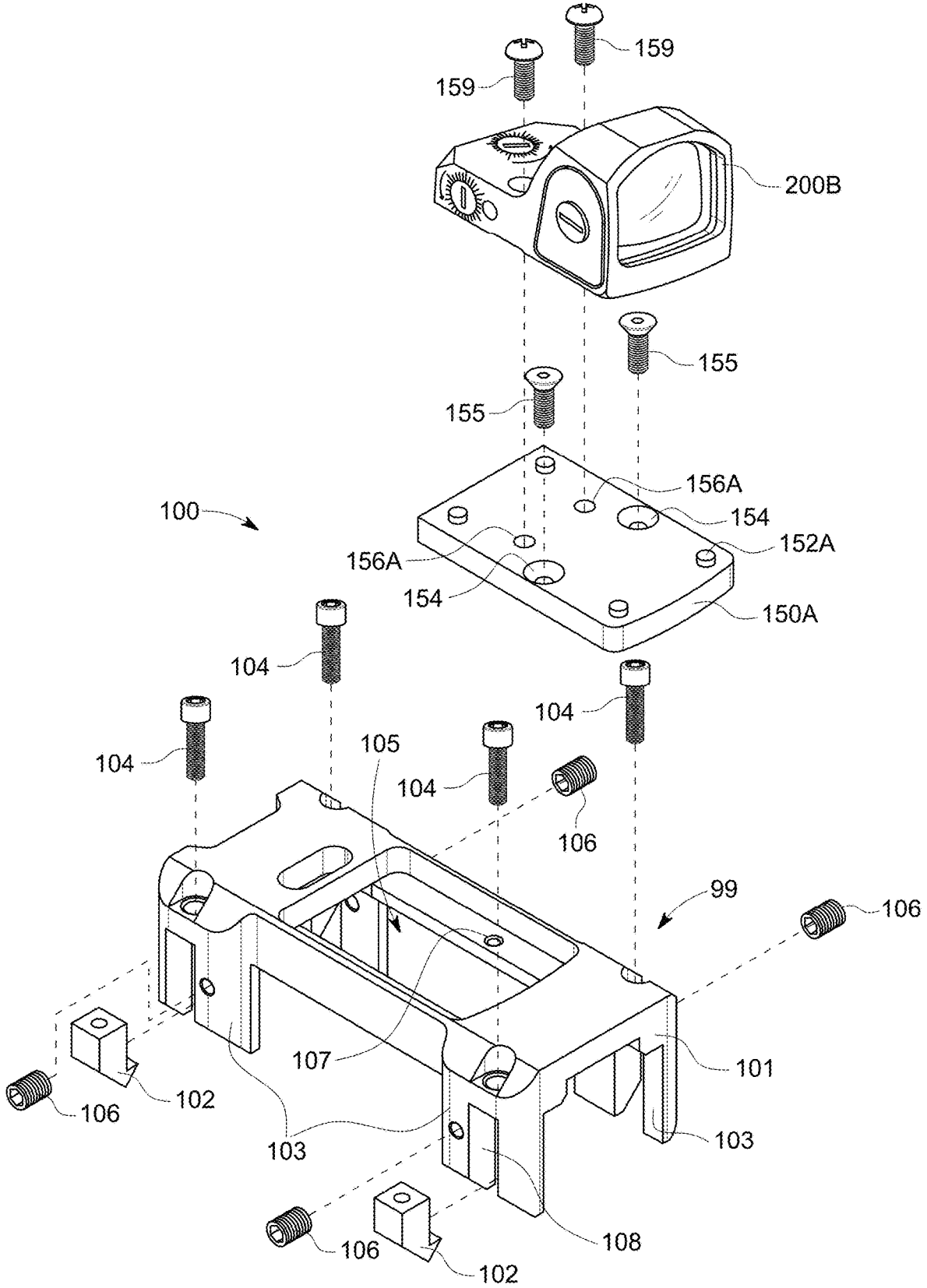
FIG. 2 is exploded view of the red dot emitter mounting system showing one specific mounting plate and a red dot emitter.

Reference will now be made in detail to the presently preferred embodiments of the invention, examples of which are illustrated in the accompanying drawings. Throughout the following detailed description, the same reference numerals refer to the same elements in all figures.

Referring to FIG. 1, a diagram of an exemplary implementation of the red dot emitter/reflex sight mounting system 100 is described.

The red dot emitter/reflex sight mounting system 100 has a frame 99 that includes a base 101 with a set of downwardly depending legs 103. In one embodiment, as depicted in FIG. 1, the frame 99 of the red dot emitter/reflex sight mounting system 100 is shown with four legs 103, however, nothing herein limits the use of less than or more than four legs 103. The number of legs 103 employed is dependent on the weapon 32 on which the red dot emitter/reflex sight mounting system 100 is to be used. As will be discussed hereinafter, the present invention is intended to be used with many particular models of weapons manufactured by many different companies, though one particular weapon 32 is shown. Therefore, in the embodiment shown, four legs 103 are provided. However, it is understood that if the red dot emitter/reflex sight mounting system 100 attaches in the same manner as described herein, but to a different weapon not mentioned herein.

In the example shown, two of the legs 103 (the back legs) are disposed proximal to back end 30 of the weapon 32 while two legs 103 (the front legs) are disposed slightly forward of middle portion.

In the weapon 32 used as an example, flanges 84 are formed on each side (note the opposing side is symmetrical with respect to the flanges 84) in which the clips 102 of the legs 103 engage to hold the red dot emitter/reflex sight mounting system 100 to the weapon.

As noted above, there are many different red dot emitters manufactured by several different companies, having many different mounting configurations. It would be possible to make a different red dot emitter/reflex sight mounting system for each different mounting configuration, but such would require the manufacturing, shipping, stocking and marketing of many different red dot emitter/reflex sight mounting systems. This would be further compounded should different bases (e.g., a base like base 101 of FIGS. 2-5) be needed for different weapons. Consider a situation in which there are 20 different red dot emitters/reflex sights and three different bases, 60 (20*3) unique configurations of red dot emitter/reflex sight mounting systems are required. As will be shown, the disclosed the red dot emitter/reflex sight mounting system 100 would require three different bases and 20 different mounting plates requiring the manufacturing, shipping, stocking and marketing of 23 parts instead of 60, of which 20 of the parts are mounting plates that have relatively low complexity and cost.

As will be described, the red dot emitter/reflex sight mounting system 100 of the present invention has two main sections. The first main section is the frame 99. A base 101 of the frame 99 has a cavity 105 for accepting any of several mounting plates 150A/150B/150C. Note that it is anticipated to provide mounting plates 150A/150B/150C for a number of different red dot emitters/reflex sights but for clarity and brevity reasons, only three such mounting plates 150A/150B/150C are shown. In the embodiments shown, the desired mounting plate 150A/150B/150C is ready to be inserted into the cavity 105 and secured with two screws 155 passing through holes 154 in the mounting plates 150A/150B/150C and securing in threaded holes 107 in the base 101. Note that in this embodiment, the two screws 155 are flat headed screws and the holes 154 in the mounting plates 150A/150B/150C are countersunk to the size of the heads of the screws 155. Note that although two screws 155 are shown, any number of screws 155 are anticipated, including zero, in which case a different retaining mechanism is used such as a spring-loaded detent or other retaining configuration as known in the industry. Additionally, although in this embodiment, the holes 107 are shown as threaded, in some embodiments, the holes 107 are not threaded and the screws 155 are held using nuts (not shown for clarity and brevity reasons).

The frame 99 has legs 103 (four legs 103 are shown in this embodiment). Each leg 103 has a clip 102 that is slideably positioned in a cutout 108 of each leg 103 and adjustably held within the cutout 108 of each leg 103 by adjustment screws 104, allowing for movement of the clip 102 up/down within the cutout 108. This mechanism holds the base 101 to the weapon 32. In some embodiments, further, fine tuning adjustment is made using set screws 106 that pass through each leg 103 and, when tightened, apply a force against the weapon. Note that although an equal number of set screws 106 are shown as legs 103, the set screws 106 are optional and it is not required to have one set screw 106 for every leg 103.

The second main section is a mounting plate 150A/150B/150C (several mounting plates 150A/150B/150C are shown as examples and many more mounting plates 150A/150B/150C are anticipated). Many other mounting plates 150A/150B/150C are anticipated, one for each mounting pattern of a different red dot emitter/reflex sight. As discussed above, each mounting plate 150A/150B/150C has features such as holes 154 through which the screws 155 pass for securing the mounting plates 150A/150B/150C to the frame 99. Some features of each mounting plate 150A/150B/150C provide for mounting of a specific red dot emitter/reflex sight 200A. For example, the mounting plate 150A of FIG. 2 has four cylindrical bumps 152A that match holes (not shown) in a specific red dot emitter/reflex sight 200A (red dot emitter in this example); and two mounting holes 156A (again, any size hole is anticipated). This specific red dot emitter/reflex sight 200A mounts using two mounting screws 159 that pass through holes in this specific red dot emitter, through mounting holes 156A in the mounting plate 150A and are held by either threads in the mounting holes 156A or held by nuts tightened on the mounting screws 159 below the mounting plate 150A (not shown for brevity and clarity reasons). Note that although called "mounting screws 159," any fastener is anticipated including rivets, bolts, etc. Note that the mounting bumps 152A are peculiar to the specific red dot emitter/reflex sight 200A and any type of feature or surface contour that matches any other red dot emitter is fully anticipated, for example, rectangular bumps, triangular bumps, no bumps, etc.

Figure 3:
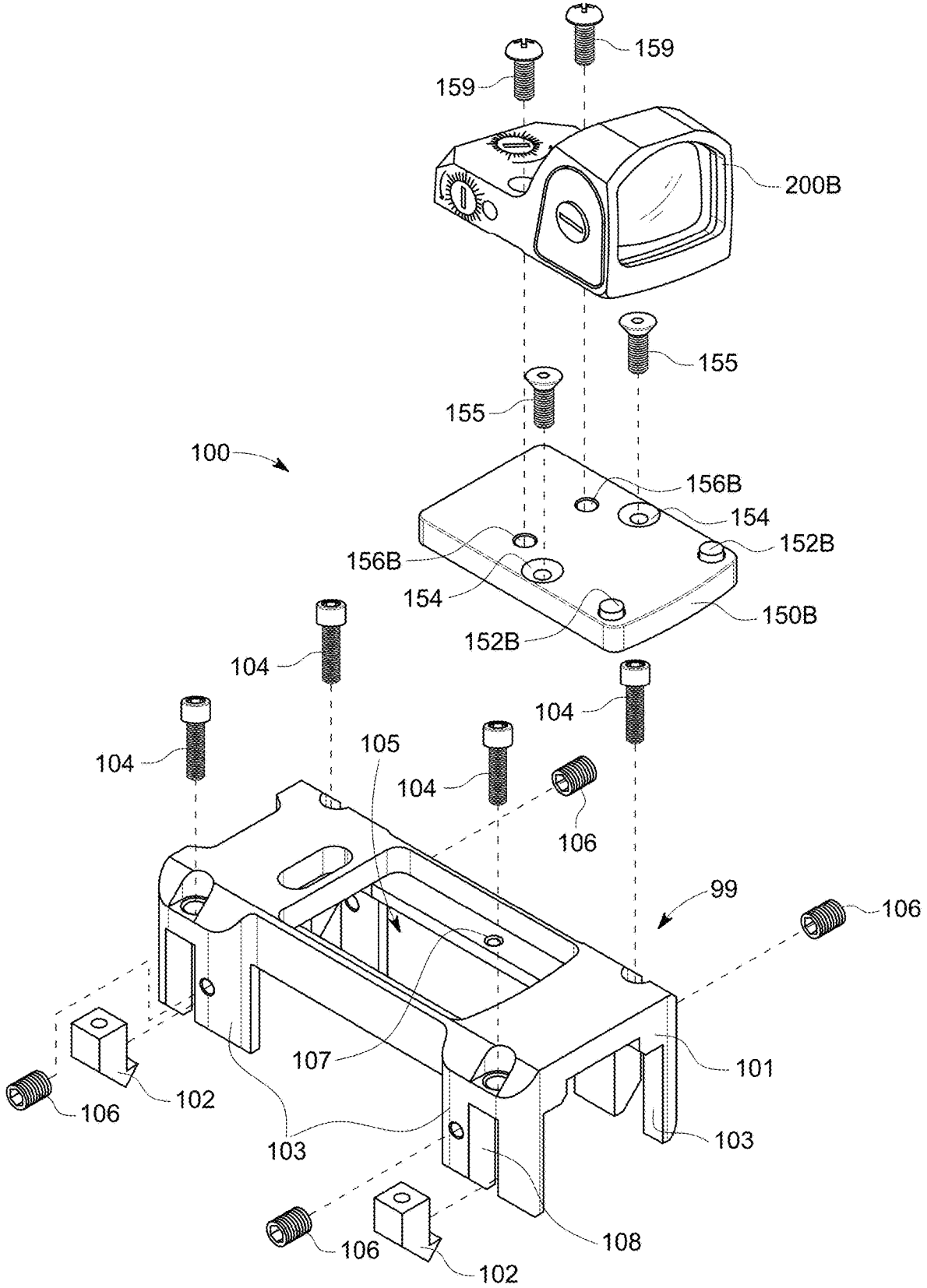
FIG. 3 is exploded view of the red dot emitter mounting system showing another specific mounting plate and another red dot emitter.

Another example that is shown in FIG. 3 has the mounting plate 150B with two cylindrical bumps 152B that match holes (not shown) in a specific red dot emitter/reflex sight 200B; and two mounting holes 156B. This specific red dot emitter/reflex sight 200B mounts using two mounting screws 159 that pass through holes in this specific red dot emitter/reflex sight 200B, through/into mounting holes 156B in the mounting plate 150B and are held by either threads in the mounting holes 156B or a nut below the mounting plate 150B (not shown for brevity and clarity reasons).

Figure 4:
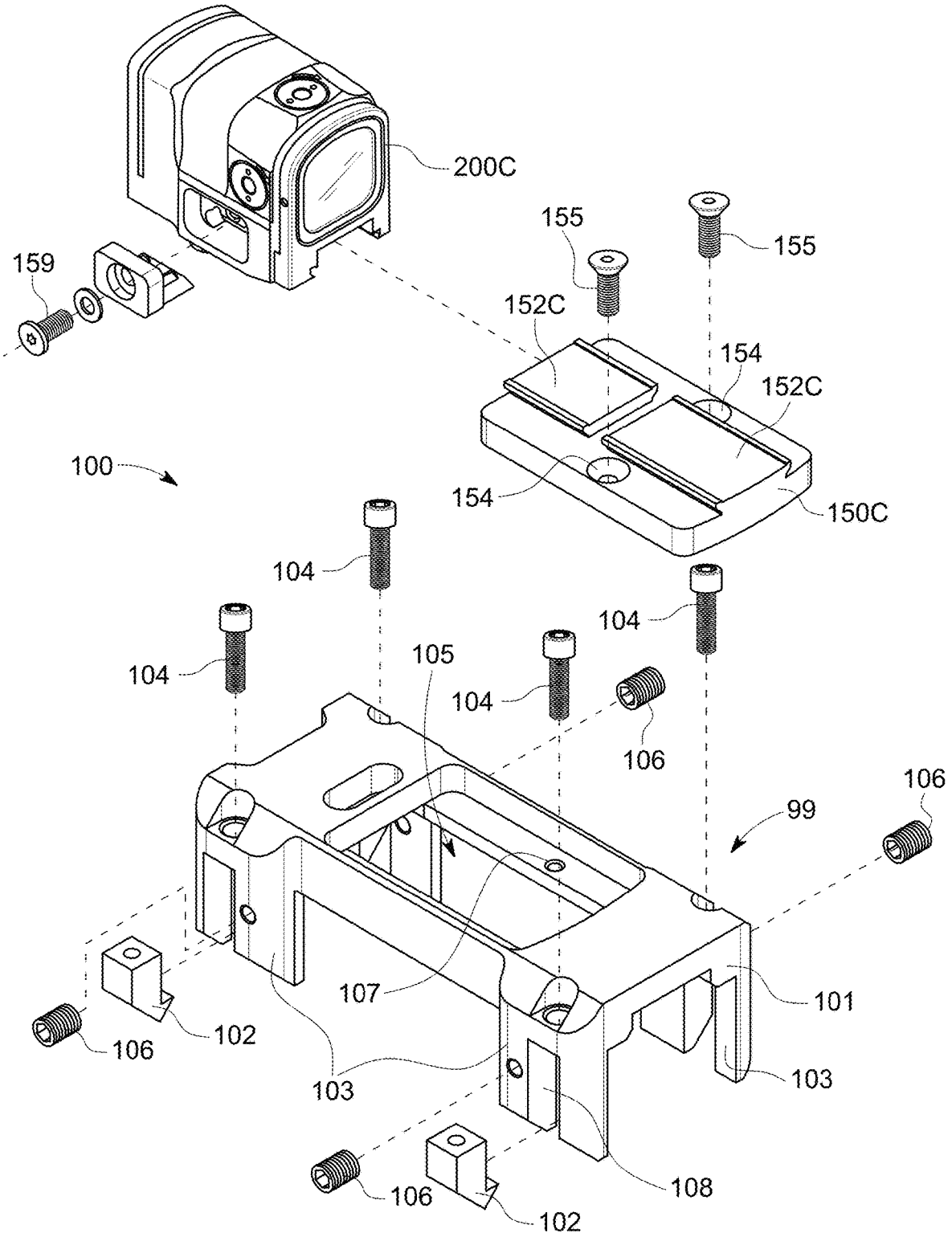
FIG. 4 is exploded view of the red dot emitter mounting system showing another specific mounting plate and another red dot emitter.

Another example shown in FIG. 4 has a mounting plate 150C with rails 152C that match tracks/holders (not shown) in a specific red dot emitter/reflex sight 200C. For this specific red dot emitter/reflex sight 200C, the specific red dot emitter/reflex sight 200C is slid onto the rails 152C and held to the rail 152C with a self-contained screw locking plate after the mounting plate 150C is attached to the base 101 by screws 155 passing through holes 154.

Figure 5:
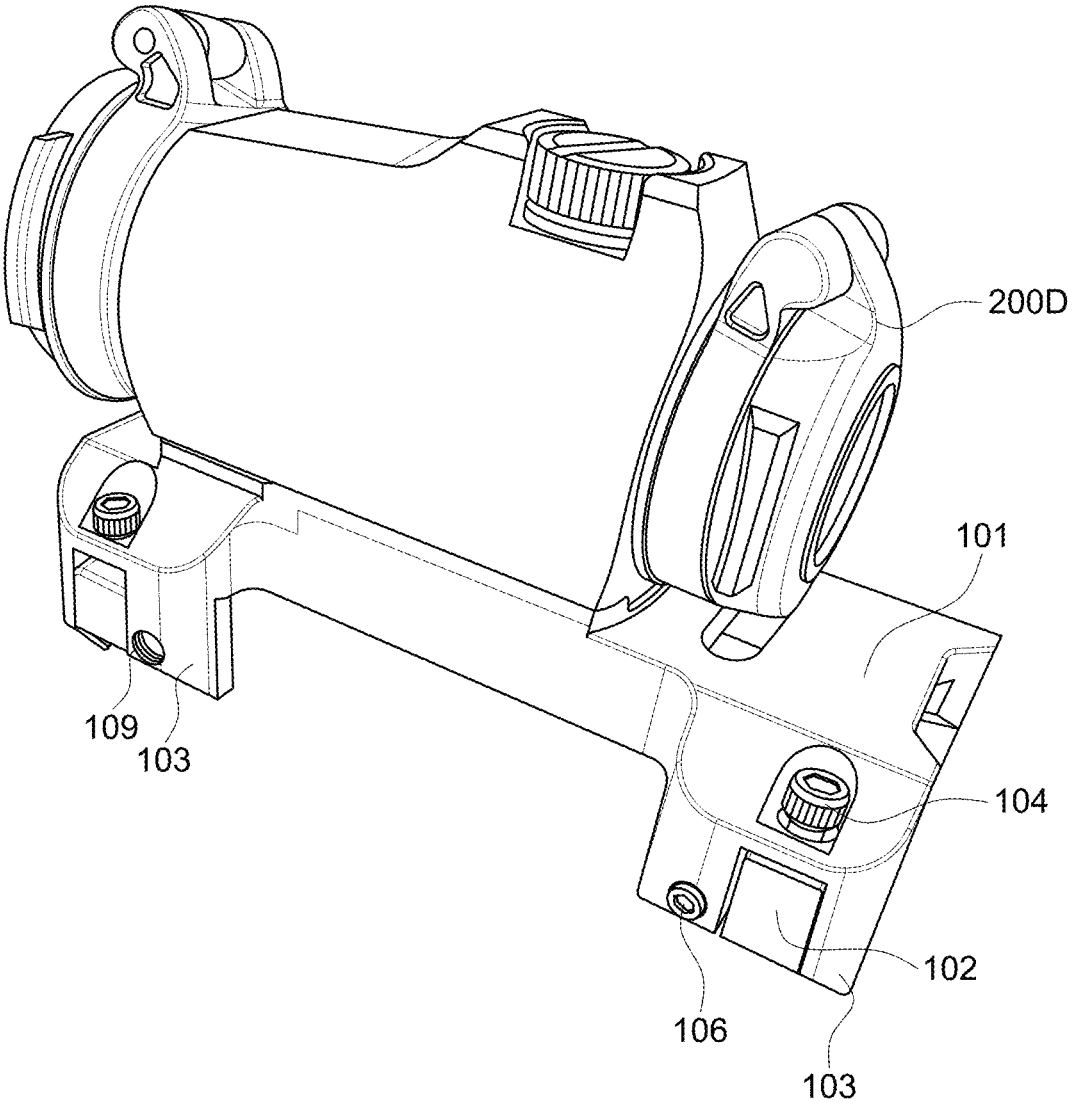
FIG. 5 is a perspective view of still another red dot emitter affixed to a mounting plate and held to a frame of the red dot emitter mounting system.

Referring to FIG. 5, a fourth type of red dot emitter/reflex sight 200D is shown attached to the red dot emitter/reflex sight mounting system 100. One hole 109 for the set screws 106 is shown without a set screw 106, showing the threads.

Equivalent elements can be substituted for the ones set forth above such that they perform in substantially the same manner in substantially the same way for achieving substantially the same result.

It is believed that the system and method as described and many of its attendant advantages will be understood by the foregoing description. It is also believed that it will be apparent that various changes may be made in the form, construction and arrangement of the components thereof without departing from the scope and spirit of the invention or without sacrificing all of its material advantages. The form herein before described being merely exemplary and explanatory embodiment thereof. It is the intention of the following claims to encompass and include such changes.

The invention claimed is:

1. A system for mounting a red dot emitter or reflex sight to a weapon, the system comprising:

a plurality of mounting plates each corresponding to a plurality of red dot emitters and reflex sights, a mounting plate selected from the plurality of mounting plates, the mounting plate having features for affixing the red dot emitter or the reflex sight to the mounting plate;

a base, the base comprising an orifice for accepting the mounting plate and a plurality of legs for engaging with the weapon;

a plurality of clips, each clip slideably interfaces into a cutout of each leg of the plurality of legs and each clip is adjustably held within the cutout by an adjustment screw; and wherein the mounting plate is sized to fit and be held in the orifice, wherein the base has at least one hole within the orifice for accepting the mounting plate and the mounting plate has a corresponding hole through which a screw is used to hold the mounting plate within the base, and wherein the at least one hole within the orifice for accepting the mounting plate is threaded.

2. The system of claim 1, wherein the features include holes for affixing the red dot emitter or the reflex sight to the mounting plate using screws.

3. The system of claim 1, wherein the features include bumps for aligning the red dot emitter or the reflex sight to the mounting plate.

4. The system of claim 1, wherein the features include rails for affixing the red dot emitter or the reflex sight to the mounting plate.

5. The system of claim 1, wherein the orifice for accepting the mounting plate has a rectangular cross-section and the mounting plate has a mounting plate rectangular-cross section that corresponds to the rectangular cross-section of the orifice.

6. The system of claim 1, wherein at least one leg of the plurality of legs includes a set screw, each set screw is positioned such that tightening of the each set screw causes the each set screw to exert force against the weapon, therefore providing for fine adjustment of the system for mounting the red dot emitter or the reflex sight to the weapon.

7. A method of mounting a red dot emitter or reflex sight to a weapon, the method comprising:

providing a plurality of mounting plates, each mounting plate having features for affixing a red dot emitter or reflex sight thereto;

selecting a mounting plate, from the plurality of mounting plates, that corresponds to a specific red dot emitter or reflex sight;

affixing the mounting plate within an orifice of a base, the base having a plurality of legs for engaging with the weapon;

affixing the red dot emitter or the reflex sight to the mounting plate;

engaging clips with the weapon, each clip being slideably interfaced into a cutout of each leg of the plurality of legs and each clip being adjustably held within the cutout by an adjustment screw; and tightening the adjustment screw of each clip to hold the base, and therefore, the red dot emitter or the reflex sight, to the weapon, wherein the base has at least one threaded hole within the orifice and the mounting plate has a corresponding hole and the step of affixing the mounting plate within the orifice of the base comprises passing at least one screw through each corresponding hole and into a corresponding threaded hole of the at least one threaded hole and tightening the at least one screw.

8. The method of claim 7, wherein the features include holes for affixing the red dot emitter or the reflex sight to the mounting plate using screws.

9. The method of claim 7, wherein the features include bumps for aligning the red dot emitter or the reflex sight to the mounting plate.

10. The method of claim 7, wherein the features include rails for affixing the red dot emitter or the reflex sight to the mounting plate.

11. The method of claim 7, wherein the orifice of the base has a rectangular cross-section and the mounting plate has a mounting plate rectangular-cross section that corresponds to the rectangular cross-section of the orifice.

12. The method of claim 7, wherein at least one leg of the plurality of legs includes a set screw, and the method further comprises adjusting the set screw, thereby exerting force against the weapon, providing for fine adjustment of the red dot emitter or the reflex sight.

13. A method of mounting a selected red dot emitter or reflex sight from a plurality of red dot emitter or reflex sights to a weapon, the method comprising:

affixing the selected red dot emitter or the reflex sight to a mounting plate selected from a plurality of mounting plates, one mounting plate for each red dot emitter or the reflex sight in the plurality of red dot emitter or reflex sights, each mounting plate of the plurality of mounting plates having features for affixing one red dot emitter or the reflex sight of the plurality of red dot emitter or reflex sights thereto;

installing the mounting plate to a base that comprises a plurality of legs for engaging with the weapon, the base having a plurality of clips, each clip slideably interfaces into a cutout of each leg of the plurality of legs and each clip is adjustably held within the cutout by an adjustment screw; and engaging each clip with the weapon and tightening each adjustment screw to hold the base to the weapon and align the one red dot emitter or the reflex with the weapon, and therefore, holding the one red dot emitter or the reflex sight to the weapon, wherein the mounting plate fits within an orifice of the base, the orifice has a rectangular cross-section and the mounting plate has a rectangular-cross section that corresponds to the rectangular cross-section of the orifice, wherein the base has at least one hole within the orifice for accepting the mounting plate and the mounting plate has a corresponding hole through which a screw is used to hold the mounting plate within the base, and wherein the at least one hole within the orifice for accepting the mounting plate is threaded.

14. The method of claim 13, wherein the features include holes for affixing the one red dot emitter or the reflex sight to the mounting plate using screws.

15. The method of claim 13, wherein the features include bumps for aligning the one red dot emitter or the reflex sight to the mounting plate.

16. The method of claim 13, further comprising adjusting set screws, each of the set screws being in a corresponding one of the plurality of legs, tightening of each of the set screws pushing against the weapon for fine adjustment.

* * * * *